US005660131A

United States Patent [19]

Gulling et al.

[11] Patent Number: 5,660,131

[45] Date of Patent: Aug. 26, 1997

[54] ICEBREAKER ATTACHMENT

[76] Inventors: Daniel L. Gulling, 2666 Seneca Ct., Greenbay, Wis. 54313; David Cassidy, 697 Mollies Way, DePere, Wis. 54115; Craig W. Rigby, 1619 7th St., Menominee, Mich. 49858; Bernard F. Bentgen, 2315 Riverside Ave., Marinette, Wis. 54143

[21] Appl. No.: 644,254

[22] Filed: May 10, 1996

[51] Int. Cl.[6] ..... B63B 35/08

[52] U.S. Cl. ..... 114/40; 114/248

[58] Field of Search ..... 114/40–42, 248

[56] References Cited

U.S. PATENT DOCUMENTS

| | | | |
|---|---|---|---|
| 3,799,101 | 3/1974 | Finefrock | 114/248 |
| 4,208,977 | 6/1980 | Jahns et al. | 114/40 |
| 4,326,476 | 4/1982 | Pole | 114/40 |
| 4,409,918 | 10/1983 | Wagner | 114/40 |
| 4,427,393 | 1/1984 | May | 440/67 |
| 4,428,735 | 1/1984 | Gruzling et al. | 114/40 |
| 4,436,046 | 3/1984 | Braley | 114/42 |
| 5,038,695 | 8/1991 | Varges | 114/40 |
| 5,176,092 | 1/1993 | Czimmek | 114/40 |
| 5,218,917 | 6/1993 | Harjula et al. | 114/40 |
| 5,325,803 | 7/1994 | Jans et al. | 114/40 |
| 5,460,110 | 10/1995 | Eronen et al. | 114/41 |

FOREIGN PATENT DOCUMENTS

| | | | |
|---|---|---|---|
| 88693 | 5/1985 | Japan | 114/42 |

OTHER PUBLICATIONS

Model and Full–Scale Tests with an Innovative Icebreaker Bow, Transactions, vol. 94, pp. 325–351, (1986).

*Primary Examiner*—Jesus D. Sotelo

*Attorney, Agent, or Firm*—Niro, Scavone, Haller & Niro

[57] ABSTRACT

A self-powered icebreaker attachment for connection to a parent vessel. In the preferred embodiment, the icebreaker attachment includes a spoon-shaped bow, an ice knife positioned aft of the bow, and a propulsion system including fully rotatable Z-drives. Preferably, the icebreaker attachment is itself a flotable vessel whose propulsion system can be coordinated with the propulsion system of the parent vessel to minimize ice-breaking-related forces on the parent vessel. The propulsion systems of the two vessels can be controlled by either the crew of the parent vessel or of the icebreaker attachment vessel.

21 Claims, 6 Drawing Sheets

ICEBREAKER ATTACHMENT

BACKGROUND OF THE INVENTION

This invention is generally directed to an icebreaker vessel. More specifically, the invention is directed to a separately-powered icebreaker attachment for a ship.

A conventional icebreaker vessel is especially designed for icebreaking. Since the operating season of an icebreaker is normally only a few months in each year, during the greater portion of each year the money invested in an icebreaker is non-performing. Also, the desirability of navigation in cold climates is offset by the tremendous capital cost of building large icebreaker vessels for use (for example) on the Great Lakes. Therefore, there is a need for a a vessel that can be used both as an icebreaker and also, during the "off-season," for off-shore supply, diving support, towing, research, entertainment, or other purposes.

Contemporary ice breaking is performed by icebreakers in two principal modes: (1) a continuous mode, in which the ship is driven forward through the ice at varying speeds (restrained only by the ice resistance), but during which forward movement is typically never totally impeded; and (2) a ramming mode, in which the icebreaker encounters ridge ice of such a thickness that the forward motion cannot be maintained continuously and the ship comes to a stop after having crushed the ice under her forefoot. In the ramming mode, the ship is then backed away from the ice an appropriate distance and then again moved forward against the ice. An icebreaker must be designed for safe and efficient operation in each of these ice breaking modes.

One principal reason for using an icebreaker is to provide safe travel for vessels that do not possess ice breaking capability. Thus, the icebreaker should be able clear a channel equal to the width of the ship's beam, without leaving large chunks of ice strewn throughout its wake. Such large ice chunks can be of considerable size and weight, and can continue to provide a hazard to the icebreaker hull, propellers and rudders, while smaller ice pieces can move under the hull and clog underwater hull openings such as sea chests and thruster ports. In addition to preventing these hazards, the formation of a clear path allows escorted vessels to travel more safely, and also reduces the amount of brash ice (or residual ice that can refreeze) so that other vessels can use the path for a longer period of time. Icebreakers are also used for other related duties such as channel widening, removing floating ice chunks, providing turnout points and turning basins, and harbor clearing. Also, icebreakers are required to free ships which are already locked in ice. This requires good maneuvering characteristics to work in close proximity with another ship. It would be preferable to provide an icebreaker that could efficiently perform each of these duties, as well.

To perform such duties as channel clearing and widening, icebreakers require a relatively wide hull. This results in poor performance during open water operations, since such hull designs do not efficiently dampen the rolling motion in open sea, and do not efficiently cut through the open water at relatively high travelling speeds.

Conventional icebreaker ships have a V-shaped bow with a wedge extending from the bottom of the stem line below the design waterline of the ship, towards the sides, until a maximum width is reached. Upon breaking of the ice by the bow, the cusps of ice move downwardly into the water along the sides of the bow until the wedge is contacted. It is then the design intention that the cusps of ice are tripped and moved away from the ship's sides and under the unbroken ice, thus protecting the propellors and leaving a clear channel behind the icebreaker. In practice, these design objectives are not always achieved.

A spoon-shaped icebreaker bow has also been used, as disclosed for example in U.S. Pat. No. 4,702,187. Relatively low resistance to breaking level ice is achieved with a spoon bow as compared to a wedge bow. The spoon bow breaks ice by riding up on the ice field until there is enough downward force to cause ice failure in the flexure mode. A spoon bow also has very good ice ridge penetration characteristics because it breaks the ice with a downward force instead of attempting to wedge the ridge apart. The energy dissipated during each ramming sequence is reduced, allowing the spoon bow to penetrate further into the ridge during each ramming cycle and reducing the overall number of backing and ramming cycles. Compared to traditional bow forms, which attempt to wedge the ice to either side, the spoon bow is much more efficient as it transfers more of the propulsion energy directly into icebreaking-related forces. Again, as with "wedge" bows it is important for spoon-shaped bows to clear the broken ice field by pushing the ice chunks underneath the ice field on either side of the icebreaker. For this purpose, a wedge-shaped ice knife has been used with a spoon-bow form.

Various icebreaker designs have been tried in an attempt to achieve some of the above-mentioned objects. For example, U.S. Pat. No. 5,218,917 discloses an icebreaker with differently-shaped fore and aft bows, so that the vessel can be turned around to move in the aft direction during non-icebreaking conditions. As another example, U.S. Pat. No. 4,436,046 mentions icebreakers that utilize explosive devices for breaking up the ice.

Accordingly, it is an object of the present invention to provide an icebreaker attachment that can be used with a conventional non-icebreaker "parent" vessel, and that can be removed to allow the parent vessel to be economically used for other activities, including efficient travel over open water.

It is a further object of the present invention to provide an icebreaker attachment that employs an efficient, spoon-shaped bow.

It is still another object to provide an ice breaking design that leaves a relatively clear channel in the wake of the ship employing the icebreaker attachment.

It is yet another object to provide a removable and attachable icebreaker that can safely and efficiently perform the various duties of an icebreaker.

Another object is to provide a parent vessel with an icebreaker attachment that itself can function as a separate floating vessel, facilitating attachment and detachment of the icebreaker to a parent vessel.

Still another object of the present invention is to power the parent ship/icebreaker combination so that the combined vessel can move efficiently through the ice.

SUMMARY OF THE INVENTION

These and other objects are achieved by the present invention, which preserves the advantages of known icebreakers, provides new advantages not found in conventional icebreakers, and overcomes many of the disadvantages of currently available icebreakers.

The invention is generally directed to an icebreaker attachment for connection to a parent vessel with a propulsion system. The icebreaker attachment is preferably an ice breaking vessel having a hull and a bow designed to serve as an ice breaker, and includes a separate propulsion system for driving the ice breaking vessel. Attachment mechanisms are used to allow the icebreaker attachment to selectively connect with or detach from a parent vessel.

In one preferred embodiment, the propulsion system of the ice breaking vessel includes at least and preferably at least two azimuthing Z-drives. Preferably, fixed-pitch propellers rotatable through a range of 360° are employed. The propeller can be at least partially encircled by a cylindrical structure, to increase the thrust efficiency of the propulsion system. It is also preferred that the propulsion system of the ice breaking vessel be able to provide thrust in slightly outboard or upward directions. (The Z-drive can be designed to be inclined or, for example, the propeller shafts can be designed to be inclined from the vertical direction.)

In a preferred embodiment, the bow of the icebreaker attachment is flattened and generally spoon-shaped. Also, an ice knife is positioned on the hull of the ice breaking vessel and located rearward of the waterline on the icebreaker attachment, for presenting a vertical wedge which sweeps any extraneous ice pieces outboard. In addition to an ice knife, a vertical extending enclosure or "ice fence" can be used. The ice fence is useful for trapping ice pieces, and extends vertically below the hull of the ice breaking vessel, at the rearward end of the ice breaking vessel. The ice knife and ice fence function together to prevent ice pieces from interfering with the propulsion system of the parent vessel.

The ice breaker attachment can be connected to the parent vessel in a variety of ways. As one example, one of the attachment mechanisms can large pins for mating with corresponding apertures located on a rear portion of the ice breaking vessel, and a forward portion of the parent vessel. The icebreaker vessel could also have a notch located at its rear end, and lined with a resilient material, for mating engagement with a corresponding portion of the bow of the parent vessel. The ice breaker attachment can be rigidly connected to the parent vessel, or it can be connected in a manner that allows the attachment to rotate in one degree of freedom (such as pitch).

In a preferred embodiment, the propulsion systems of the ice breaking vessel and the parent vessel are in electrical communication, and are controllable at a single location on either the ice breaking vessel or the parent vessel.

A method for providing a parent vessel with ice breaking capabilities also forms a part of the present invention. The method includes the steps of: providing an ice breaking structure having a hull and a bow; providing a propulsion system associated with the ice breaking structure for driving the ice breaking structure; and attaching the ice breaking structure to a parent vessel having its own propulsion system. Preferably, control over the propulsion systems of the ice breaking structure and the parent vessel is coordinated so that a relative equilibrium is reached in which the ice-breaking-related forces on the parent vessel are minimized.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DESCRIPTION OF THE PREFERRED EMBODIMENTS

Figure 1:
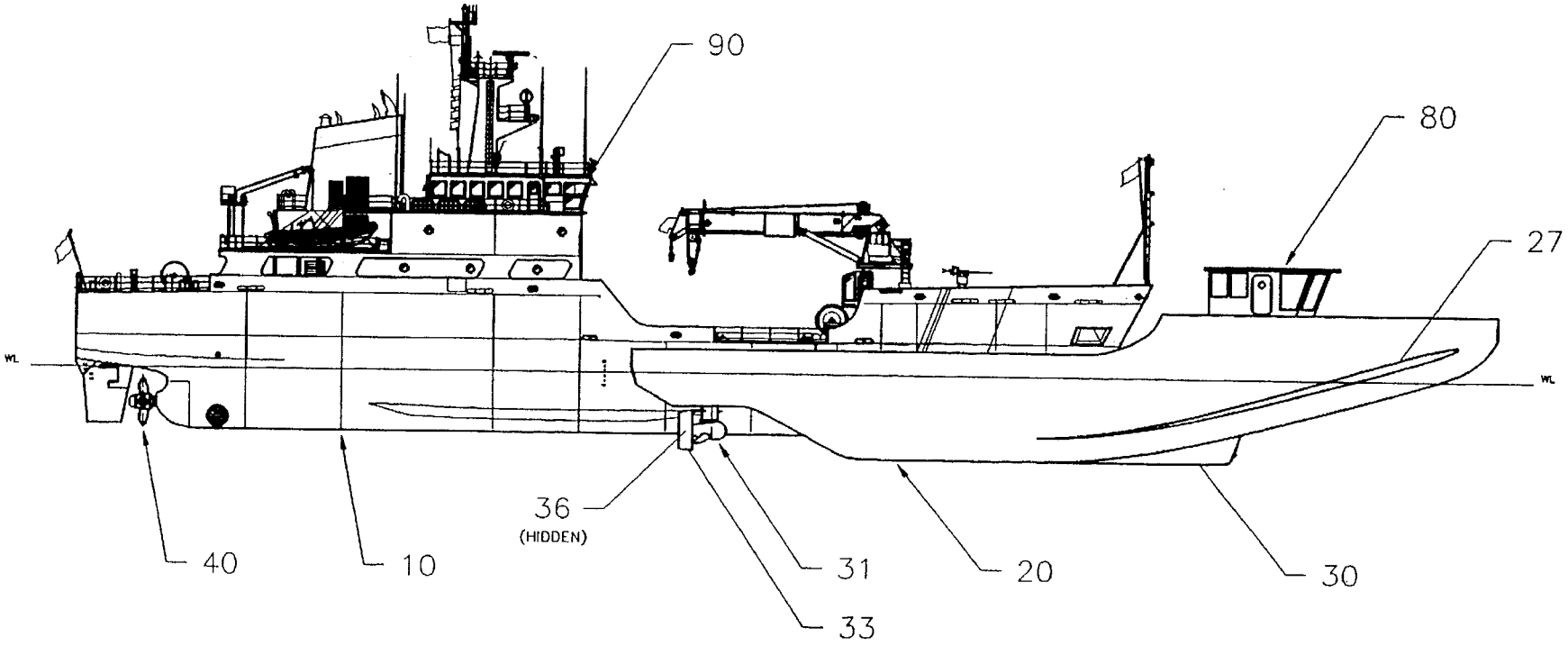
FIG. 1 is a side perspective view of the combination parent vessel and icebreaker attachment vessel of the present invention.

Referring to FIG. 1, the integrated icebreaker attachment vessel of the present invention, designated generally as 20, is shown connected to a parent or companion vessel, designated generally as 10. Icebreaker attachment vessel 20 is designed to function in a seaworthy capacity either alone, or when connected in combination with parent vessel 10. Parent vessel 10 can take a variety of vessel forms (such as a Juniper Class WLB Coast Guard vessel, a yacht, etc.), and can be used without icebreaker attachment vessel 20 for any of a variety of functions, such as operations as a Coast Guard vessel (e.g., for use in buoy deployment), for diving support, as a supply vessel, etc.

Several design variations are possible to interface vessel 10 with integrated icebreaker attachment vessel 20. Independent of the specific design utilized, the attachment method should be capable of integrating the two vessels in a short period of time, without the need for drydocking or for significant structural modifications. The preferred design will also maximize the overall icebreaking performance of icebreaker attachment 20.

Generally, the preferred attachment method is a three-point connection, with attachments at the bow of vessel 10, and two separate connections at the rear or aft end of each half of attachment 20. In one attachment design, a three-point, rigid connection is created. In a second, alternative attachment design, a two-point, rigid connection is provided, with the third attachment point allowing icebreaker attachment 20 to rotate, relative to parent vessel 10, in one degree of freedom (pitch, or rotation about the horizontal axis). In either attachment design, various methods of attachment can be used. As an example only, large pins could be used, and inserted within corresponding apertures located at the rear end of icebreaker attachment 20, and also within apertures (not shown) on either side of vessel 10. (The pins could be angled to fit within each pair of apertures, for example.) A notch, such as generally V-shaped notch 60, formed within attachment vessel 20, can be mated with the bow of parent vessel 10. For this purpose notch 60 could be lined with a resilient material 70 (e.g., an elastomeric material such as rubber) to ensure a tight connection with the bow of vessel 10. Large mooring lines could then be used to tie down and tighten this connection. Those of skill in the art will recognize that various other attachment connetions or methods could be employed, and the disclosure mentioned here is intended to be only exemplary.

Preferably, icebreaker attachment 20 can function as a stand-alone floating vessel. This design attribute would be particularly advantageous during attachment or detachment of the icebreaker attachment from the parent vessel. It may even be desirable to provide icebreaker attachment vessel 20 with enough power so that it could itself function as an icebreaker (at least for relatively thin ice). Alternatively, for certain uses, there may be no need to use an icebreaker attachment which is seaworthy, or even one which can float. (For example, an icebreaker with separate ballast tanks could be provided to make the icebreaker floatable.)

While the forces encountered by icebreaker attachment 20 during ice breaking will be very large, the reactions at the attachment points can be mitigated because attachment vessel 20 is providing at least a portion of its own thrust. Thus, during level ice breaking operations when the icebreaker is operating in the continuous mode, an equilibrium can be reached in which the forces on parent vessel 10 are relatively minimal. Accordingly, the dynamic forces induced by ridge penetration during the ramming mode will drive the structural design of the connection points.

Figure 5:
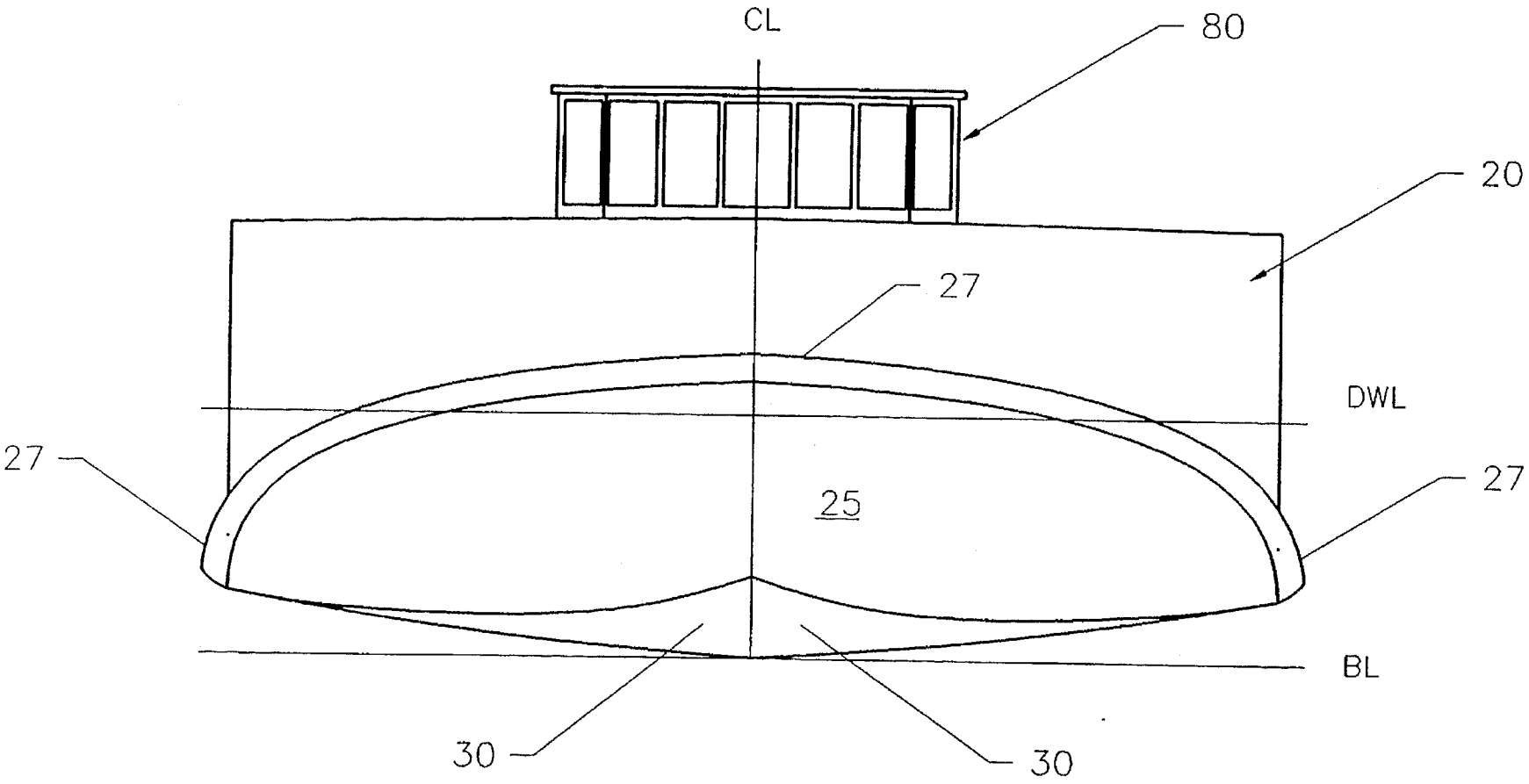
FIG. 5 is a front view of the icebreaker attachment.
Figure 6:
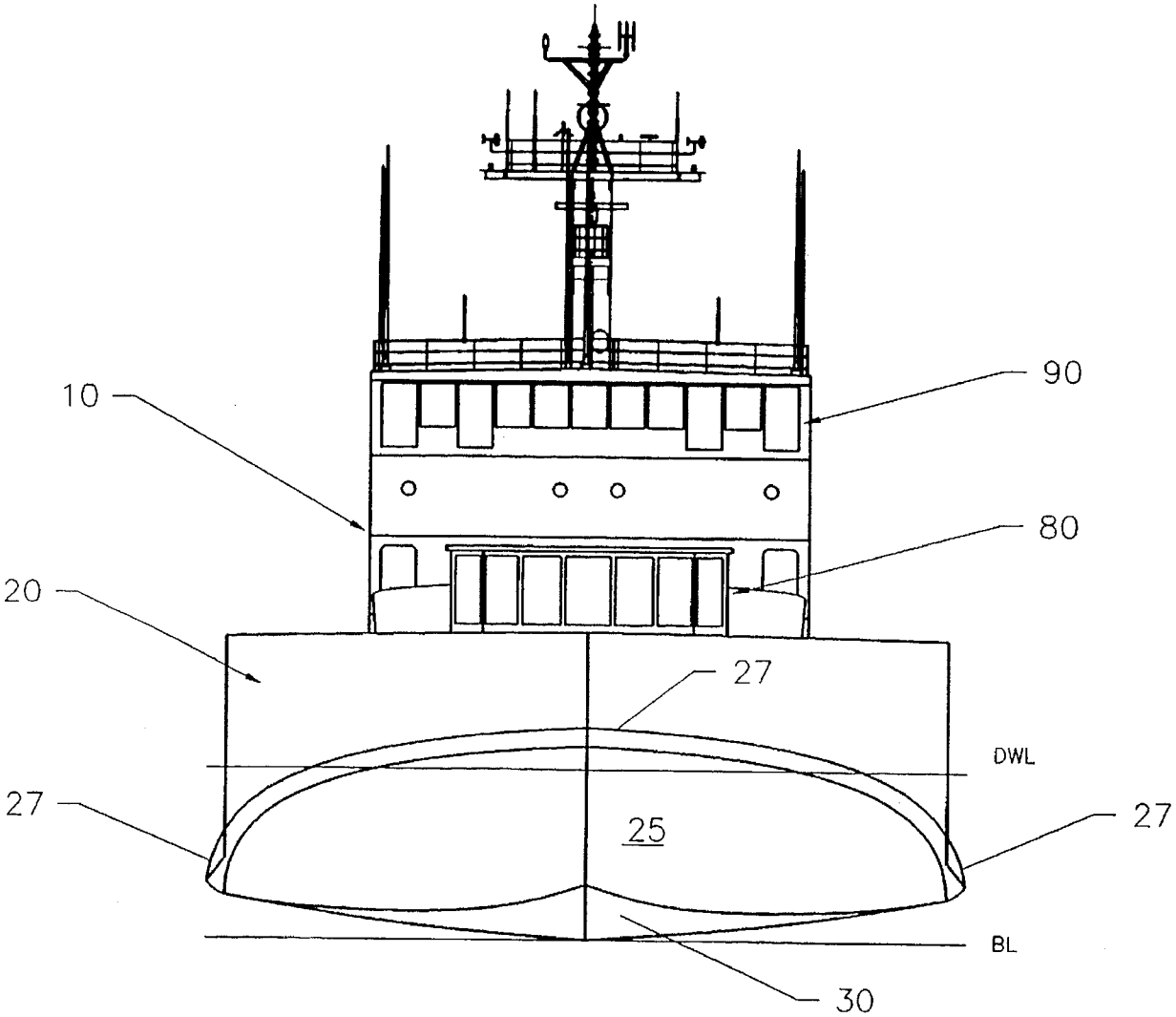
FIG. 6 is a front view of the combination parent vessel and icebreaker attachment.

Icebreaker attachment 20 preferably has a chined spoon-bow 23, as shown in the drawings. Hull 25 extends beyond its nominal beam in the forward bilge region to form reamers 27, as best shown in FIG. 5. Reamers 27 aid in clearing the broken ice path by pushing the ice out under the ice field on either side of the bow. The reamers also help reduce the turning radius of the vessel in an ice field, due to the extra clearance for the vessel that they provide.

Figure 3:
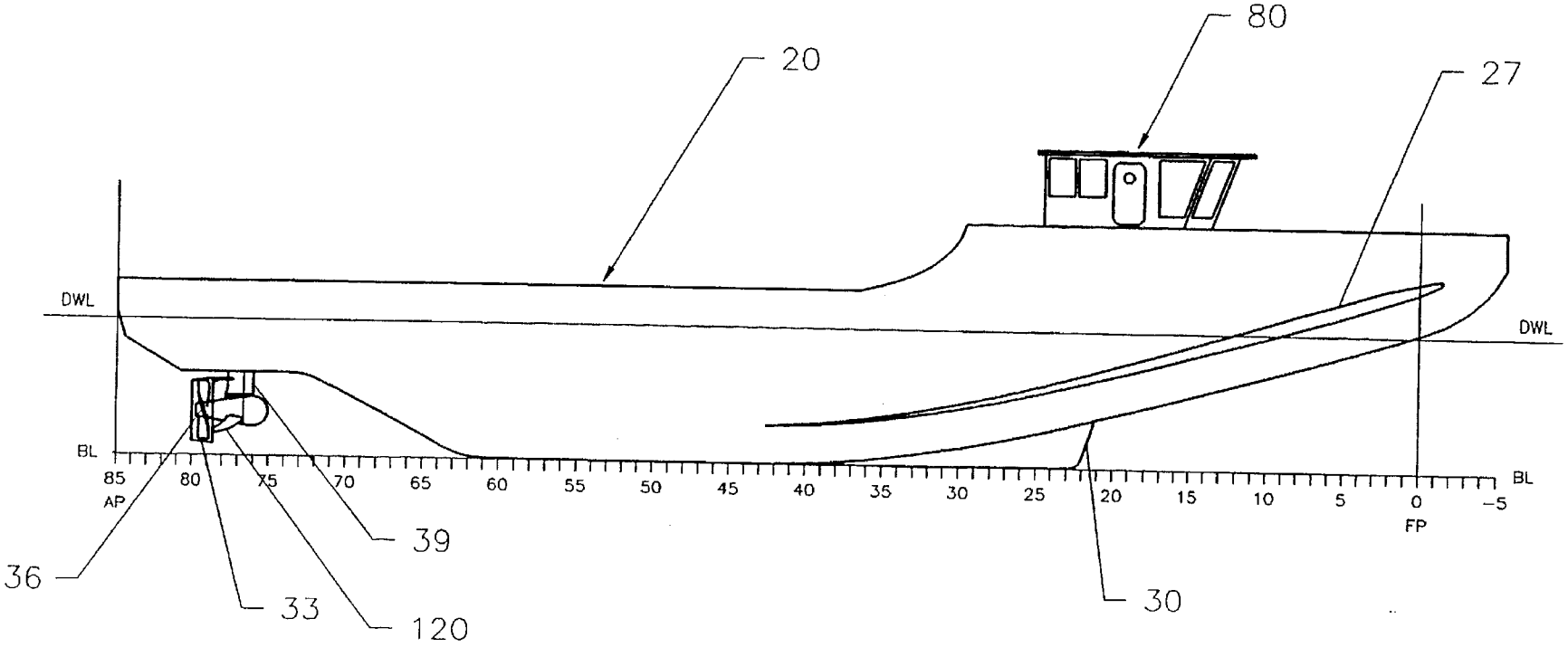
FIG. 3 is a side view of the icebreaker attachment vessel.

Spoon-bow 23 breaks the ice into large sections which are pushed down along the stem of icebreaker attachment 20. As the broken ice is submerged and moved along the bottom of the hull, the buoyancy of the ice forces the ice pieces to slide out along the deadrise toward the chine, and then under the surrounding ice field. An ice knife 30, located aft of the forward perpendicular, as shown in FIGS. 1 and 3, aids in this process by presenting a vertical wedge which sweeps any extraneous ice pieces outboard. (The proper positioning of the ice knife is related to the bow shape and the weight and centers of gravity of icebreaker 20; if icebreaker 20 can rotate relative to parent vessel 10, the length of the vessel combination is not a factor in the positioning of the ice knife.) The presence of ice knife 30 virtually eliminates the possibility of any large pieces of ice finding their way into propulsion system 31 of icebreaker attachment 20. Also, by forcing the broken ice under the surrounding ice field, spoon-bow 23 creates a very clear path through the ice.

Figure 2:
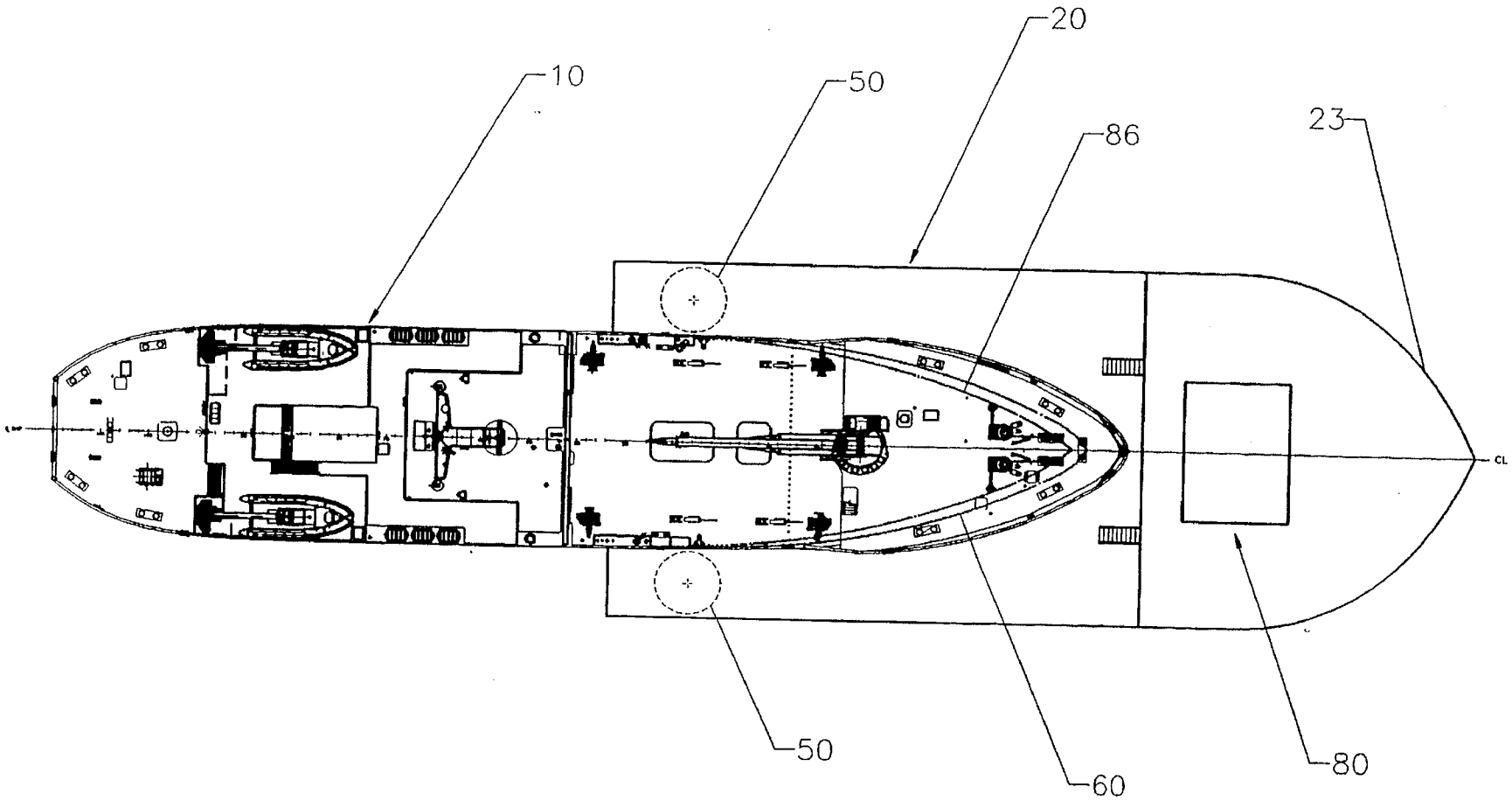
FIG. 2 is a top view of the combination vessel shown in FIG. 1.
Figure 4:
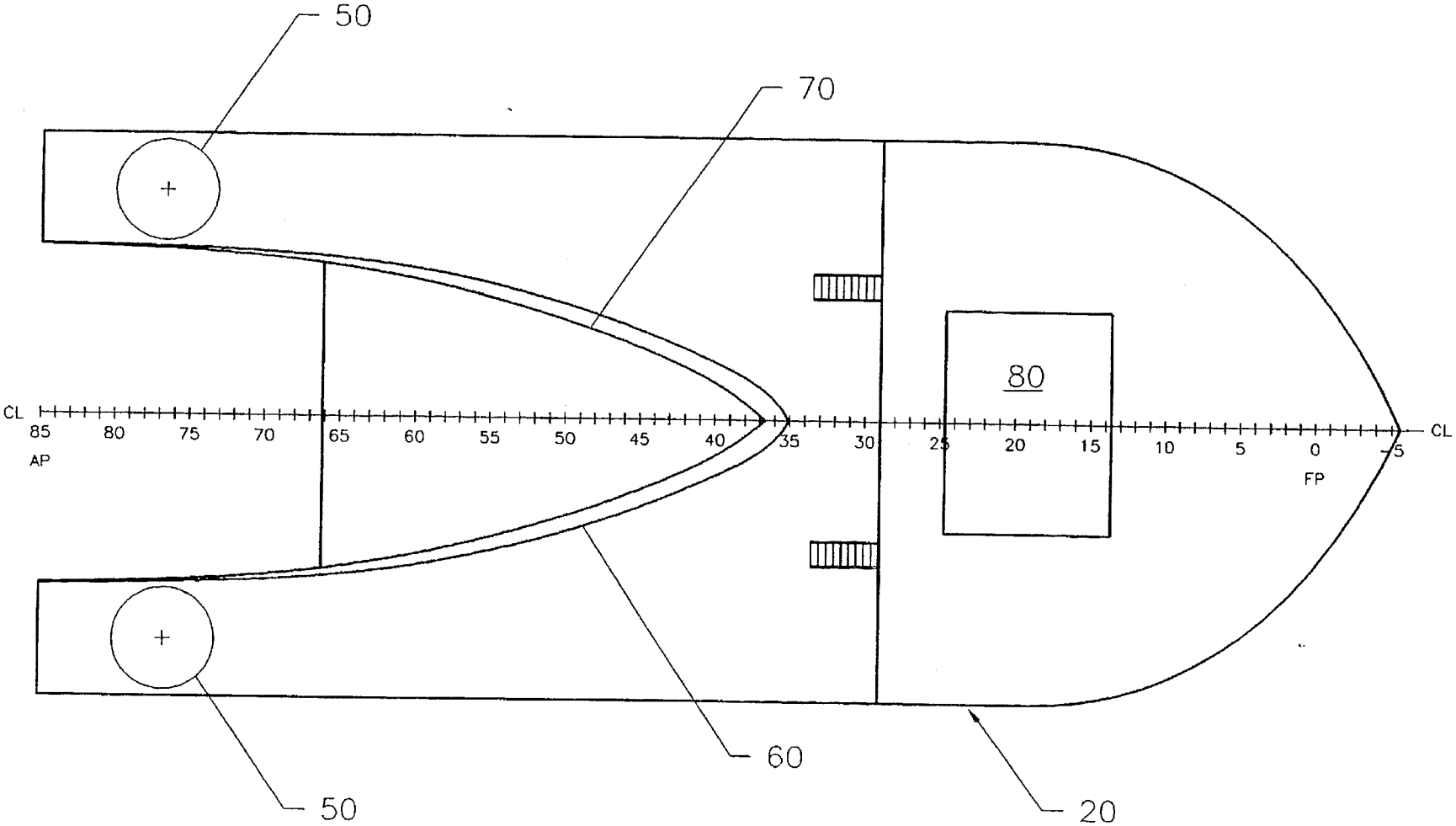
FIG. 4 is a top view of the icebreaker attachment vessel.

Icebreaker attachment 20 is preferably self-powered. In the preferred design, propulsion system 31 of attachment 20 includes two azimuthing propulsion units or "Z-drives". These Z-drives are each positioned on either wing of attachment 20 and, in the preferred design, they are located approximately 160 feet aft of the forward perpendicular (see FIGS. 1 and 3). Each Z-drive preferably has fixed-pitch propellor blades 36 with full 360° rotation capability. In other words, each set of propellor blades 36 can be rotated about the vertical axis of the propeller shaft 39, perpendicular to the ship length, in a complete circle (the turning circles 50 of the Z-drives are shown in FIGS. 2 and 4), enabling icebreaker attachment 20 to perform nearly instantaneous direction changes. Such enhanced maneuverability is useful in breaking free of ice, turning within a narrow free lane, or in other situations requiring rapid repositioning such as emergency support of ice-bound vessels.

Each Z-drive of propulsion system 31 is appropriately powered. For example, a diesel engine could provide 2500 horsepower each for the Z-drives. Alternatively, generators could be used to power DC motors which could then be used to power the Z-drives. It will be recognized that other powering means can be used, as well.

A nozzle 33 encloses (hidden) propellor blades 36 (see FIG. 3) on each propulsion unit, providing increased propulsion efficiency and added protection from any ice damage. In one embodiment, nozzle 33 takes the form of a small cylinder that surrounds propellor blades 36. Struts 120 connect nozzle 33 to the Z-drive propulsion unit. Nozzle 33 increases the propellor efficiency by providing enhanced thrust. By encircling the propellor blades 36, nozzle 33 also provides a protective barrier against blade contact with broken ice pieces.

In addition, a secondary, vertically extending ice "fence" or gate (not shown in the drawings) may be added below the hull of the icebreaker attachment 20, at its aft end, to ensure that ice pieces are not trapped under the parent vessel, where they can interfere with the propulsion system 40 of the parent vessel, or its other hull components.

The use of a fixed-pitch blade, whose thrust is varied by varying the speed of propellor rotation, is preferred since a stronger propulsion system that is more resistant to ice contact can be provided. (With a controllable pitch propellor, rotating pivotal connections lessen the strength of the unit.) Thus, it is believed that the use of a fixed-pitch blade will eliminate the ice-interaction problems experienced with controllable pitch propellor systems used on other icebreakers in the past. In addition, the Z-drive units can be rotated so that the thrust is generated in a slightly outboard and slightly upward direction. This will further improve the path clearing performance of icebreaking attachment 20 of the present invention.

In one preferred embodiment, the propulsion system of icebreaker attachment 20 is controlled from either one of two locations at any given time. A small pilot house 80 on the deck of icebreaker attachment 20 can be used to control the attachment vessel when operating independently of parent vessel 10. However, when the parent ship and the icebreaker attachment form an integrated unit, the propulsion system can be controlled through an umbilical-type cable from the pilothouse 90 of parent vessel 10. Preferably, the propulsion control software on vessel 10 is modified to optimize the powering of each vessel (ship 10 and icebreaker attachment 20) in order to minimize the reaction forces between the two vessels.

Structurally, in the preferred embodiment shown in the drawings, icebreaker attachment vessel 20 is similar to the structural design of the USCG Juniper Class WLB. In this example, it is transversely framed with a two-foot spacing, though changes may be preferred with specific designs. Alternating web and intermediate frames, as well as bulkheads, are sized according to ABS (American Bureau of Shipping) standards. Longitudinal bulkheads and frames are used to provide divisions for the several ballast and fuel tanks required. Due to the need for mass near the bow, it may be preferable to use permanent ballast in the forward third of attachment 20. Since, using the spoon-shaped bow design, the broken ice will be submerged below the hull before being cast aside, the shell plate is sized to meet any ABS requirements and designed to extend through the full girth of the vessel.

Referring to FIGS. 3 and 4, in a preferred embodiment, the principal dimensions of icebreaker attachment 20 are as follows (in feet): LOA, length overall (180); LBP, length between perpendiculars (170); beam length (76); draft (18); depth, at bow (32). The displacement of icebreaker attachment 20 is approximately 3200 long tons. The hull of parent ship 10 extends approximately 100 feet into the bow of icebreaking attachment 20, giving the vessels 10/20 combination an overall length of 300 feet. The beam of attachment 20 is similar in size to that of the U.S. Coast Guard Icebreaker "Mackinaw". In fact, the basic dimensions of the preferred design are similar to the Mackinaw. (Again, this is only an example and, obviously, these dimensions are subject to change with different designs and vessels intended for different purposes.)

As shown on FIGS. 3 and 4, "CL" refers to the ship centerline; "DWL" refers to design waterline; "BL" refers to the baseline or bottom line of vessel 20; "FP" refers to the forward perpendicular (typically where the waterline on the ship begins); and "AP" refers to the aft perpendicular. The units shown in these drawings are in increments of two feet; for example, the overall length of the icebreaker attachment vessel shown in FIG. 3 is 180 feet.

Based on empirical data, it is believed that the vessel 10/icebreaker attachment vessel 20 combination of the present invention, and of the dimensions discussed immediately above, will be capable of breaking a minimum of 36 inches of level ice at a speed of at least three knots. The added power of propulsion system 31 of icebreaker vessel 20, together with the propulsion system 40 of parent vessel 10, permits the vessel combination to operate at a level of performance at least equal to or greater than the traditional icebreaker.

The use of the spoon bow of the design disclosed here will also increase the speed made good (the overall distance over elapsed time), as discussed above, enabling the vessel combination of the present invention to perform efficiently as an escort icebreaker.

The vessel combination of the present invention is a highly cost effective design. For example, since a portion of the regular parent vessel 10 crew might be devoted to ATON (aids-to navigation) operations (such as buoy deployment) which are not conducted during the ice breaking season, the vessel combination can be operated by a reduced-size crew. Also, importantly, the capital cost to construct the icebreaker attachment and outfit it for attachment to an existing parent vessel will be significantly less than the cost of manufacturing a conventional icebreaker.

Another advantage of the present invention is the increased efficiency of the parent vessel design for use in open water, when the parent vessel has been disassembled from icebreaker attachment vessel 20. Thus, as shown in FIG. 2, parent vessel 10 has a sharp, V-shaped bow 86, useful for cruising in open water, as opposed to the more flattened, icebreaking spoon-bow of attachment vessel 20.

It will be understood that the invention may be embodied in other specific forms without departing from its spirit or central characteristics. The present examples and embodiments, therefore, are to be considered in all respects as illustrative and not restrictive, and the invention is not to be limited to the details given here.

We claim:

1. An icebreaker attachment for connection to a parent vessel, the parent vessel having its own propulsion system, comprising:

an ice breaking attachment having a hull and a bow designed to serve as an ice breaker;

a hydrodynamic propulsion system associated with the ice breaking attachment for driving the ice breaking attachment as a stand-alone vessel, and for facilitating propulsion of the parent vessel when the ice breaking attachment and the parent vessel are connected; and attachment mechanisms for allowing the ice breaking attachment to selectively connect with or detach from the parent vessel.

2. The icebreaker attachment of claim 1, wherein the hydrodynamic propulsion system of the ice breaking attachment includes at least one azimuthing Z-drive.

3. The icebreaker attachment of claim 1, wherein the propulsion system of the ice breaking attachment includes at least one set of propellers that are rotatable through a range of 360°.

4. The icebreaker attachment of claim 3, wherein the propellers are at least partially encircled by a cylindrical structure for increasing the thrust efficiency of the propulsion system of the ice breaking attachment.

5. The icebreaker attachment of claim 1, wherein the propulsion system of the ice breaking attachment can provide thrust in a slightly outboard direction.

6. The icebreaker attachment of claim 1, wherein the bow of the ice breaking attachment is configured to urge the broken ice underneath the ice field surrounding the parent vessel.

7. The icebreaker attachment of claim 1, further comprising an ice knife positioned on the hull of the ice breaking attachment and located rearward of the waterline on the ice breaking attachment.

8. The icebreaker attachment of claim 1, wherein one of the attachment mechanisms includes large pins for mating with corresponding apertures located on a rear portion of the ice breaking attachment, and a forward portion of the parent vessel.

9. The icebreaker attachment of claim 1, wherein the ice breaking attachment has a notch located at its rear end, for mating engagement with a bow portion of the parent vessel.

10. The icebreaker attachment of claim 1, wherein the ice breaking attachment is rigidly connected to the parent vessel.

11. The icebreaker attachment of claim 1, wherein the ice breaking attachment is connected to the parent vessel in a manner which allows the ice breaking attachment to rotate in one degree of freedom.

12. The icebreaker attachment of claim 11, wherein the one degree of freedom is pitch.

13. The icebreaker attachment of claim 1, wherein the controls for the propulsion systems of the ice breaking attachment and the parent vessel can be coordinated and are in electrical communication.

14. The icebreaker attachment of claim 1, wherein the propulsion systems of the ice breaking attachment and the parent vessel are controllable at a single location positioned on either the ice breaking attachment or the parent vessel.

15. The icebreaker attachment of claim 1, further comprising an ice knife positioned on the hull of the ice breaking attachment, the ice knife functioning to prevent ice pieces from interfering with the propulsion systems of the parent vessel and the ice breaking attachment.

16. The icebreaker attachment of claim 1, wherein the ice breaking attachment is employed with a parent vessel not having a flattened, icebreaking bow.

17. The icebreaker attachment of claim 1, wherein the ice breaking attachment includes a wedge-shaped ice knife, sloping bottom and side reamers that cooperate to urge the broken ice underneath the ice field surrounding the parent vessel.

18. An icebreaker attachment for connection to a parent vessel, the parent vessel having its own propulsion system, comprising:

a ice breaking attachment having a hull and a flattened bow;

a hydrodynamic propulsion system associated with the ice breaking attachment for driving the ice breaking attachment as a stand-alone vessel; and attachment mechanisms designed to allow the ice breaking attachment to selectively connect with or detach from the parent vessel.

19. An icebreaker attachment for connection to a parent vessel, the parent vessel having its own propulsion system, comprising:

a ice breaking attachment having a hull and a flattened bow;

a hydrodynamic propulsion system associated with the ice breaking attachment for driving the ice breaking attachment; and attachment means designed to allow the ice breaking attachment to selectively connect to or detach from the parent vessel.

20. A method for providing a parent vessel with ice breaking capabilities, comprising the steps of:

providing an ice breaking attachment having a hull and a flattened bow;

providing a hydrodynamic propulsion system associated with the ice breaking attachment for driving the ice breaking attachment as a stand-alone vessel, and for facilitating propulsion of the parent vessel when the ice breaking attachment and the parent vessel are connected; and removably connecting the ice breaking attachment to the parent vessel.

21. A method for providing a parent vessel having its own propulsion system with ice breaking capabilities, comprising the steps of:

providing an ice breaking attachment having a hull and an ice breaking bow;

providing a hydrodynamic propulsion system associated with the ice breaking attachment for driving the ice breaking attachment; and connecting the ice breaking attachment to the parent vessel, wherein control over the propulsion systems of the ice breaking attachment and the parent vessel is coordinated so that the parent vessel/attachment combination vessel is capable of achieving a relative equilibrium in which the ice-breaking-related forces exerted on the parent vessel are minimized.

* * * * *

UNITED STATES PATENT AND TRADEMARK OFFICE

CERTIFICATE OF CORRECTION

PATENT NO. : 5,660,131

DATED : August 26, 1997

INVENTOR(S) : Gulling, et al.

It is certified that error appears in the above-identified patent and that said Letters Patent is hereby corrected as shown below:

On the Title Page, Item 73, Assignee should read -- Marinette Marine, Marinette, WI --

Signed and Sealed this

Seventeenth Day of February, 1998

*Attest:*

Bruce Lehman

BRUCE LEHMAN

*Attesting Officer*

*Commissioner of Patents and Trademarks*